US006919519B2

(12) United States Patent
Ravnkilde et al.

(10) Patent No.: US 6,919,519 B2
(45) Date of Patent: Jul. 19, 2005

(54) MULTIFUNCTIONAL SWITCH

(75) Inventors: Søren Ravnkilde, Ballerup (DK); Tomas Jacobsen, Roskilde (DK)

(73) Assignee: Sonion Roskilde A/S, Roskilde (DK)

( * ) Notice: Subject to any disclaimer, the term of this patent is extended or adjusted under 35 U.S.C. 154(b) by 0 days.

(21) Appl. No.: 10/741,438

(22) Filed: Dec. 22, 2003

(65) Prior Publication Data

US 2004/0163940 A1 Aug. 26, 2004

Related U.S. Application Data

(63) Continuation-in-part of application No. 10/267,739, filed on Oct. 10, 2002, now abandoned.

(51) Int. Cl.[7] ..... H01H 3/00
(52) U.S. Cl. ..... 200/52 R; 200/16 A
(58) Field of Search ..... 200/52 R, 6 R, 200/16 R, 16 A, 16 C, 561–563, 277–277.2, 553

(56) References Cited

U.S. PATENT DOCUMENTS

| | | | | | |
|---|---|---|---|---|---|
| 2,831,082 | A | * | 4/1958 | Mason | 200/277 |
| 4,320,271 | A | * | 3/1982 | Munroe | 200/277.2 |
| 4,590,344 | A | * | 5/1986 | Kikta et al. | 200/291 |
| 4,904,833 | A | * | 2/1990 | Sato et al. | 200/557 |
| 5,045,654 | A | * | 9/1991 | Pastwa et al. | 200/291 |

FOREIGN PATENT DOCUMENTS

| | | |
|---|---|---|
| EP | 0088296 | 9/1983 |
| FR | 1537956 | 8/1968 |
| FR | 2099346 | 3/1972 |
| GB | 837433 | 6/1960 |

OTHER PUBLICATIONS

Search Report Aug. 23, 2002.

* cited by examiner

*Primary Examiner*—Lincoln Donovan
*Assistant Examiner*—M. Fishman
(74) *Attorney, Agent, or Firm*—Harness, Dickey & Pierce, PLC

(57) ABSTRACT

The present invention relates to a hearing aid multifunctional switch comprising a base part, an externally activable switch arm, and a first and a second set of contact surfaces disposed at a surface of said base part. The first set of contact surfaces is adjacently positioned so as to form a substantially continuous surface, whereas the second set of electrically isolated contact surfaces is adjacently positioned so as to form a substantially continuous surface. The second set of contact surfaces is oppositely arranged to said first set so that the two sets have pairs of corresponding contact surfaces. A contact member is movable between said pairs of contact surfaces for providing electrical contact between a pair of corresponding contact surfaces. A pressure pad, wherein at least part of said pressure pad is positioned between a resilient member and the contact member, is biased by the resilient member against the contact member so as to ensure continuous contact between the contact surfaces and the contact member.

17 Claims, 5 Drawing Sheets

MULTIFUNCTIONAL SWITCH

Figure 1:
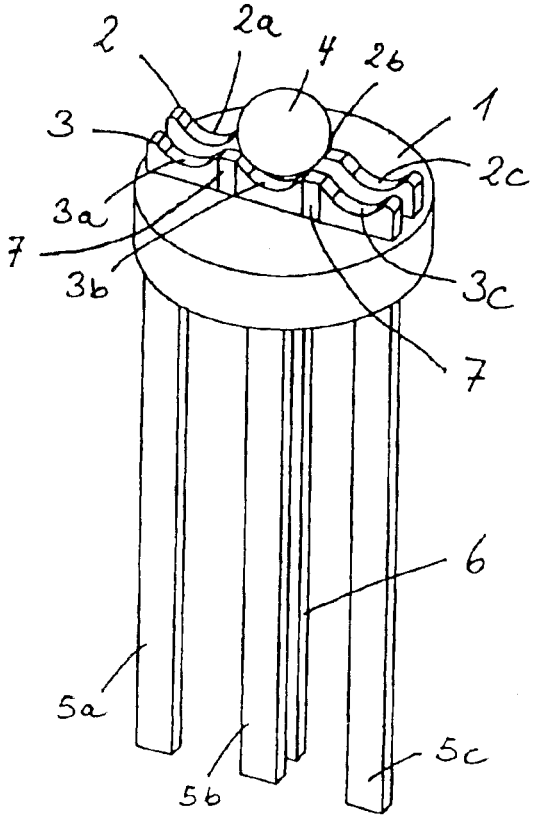

This application is a continuation-in-part of application Ser. No. 10/267,739 filed on Oct. 10, 2002 now abandoned, the entire contents of which are hereby incorporated by reference and for which priority is claimed under 35 U.S.C. § 120.

FIELD OF THE INVENTION

The present invention relates to a multifunctional switch for controlling an electrical instrument, such as a hearing instrument or a mobile phone.

BACKGROUND OF THE INVENTION

French patent FR 1.537.956 discloses a switch intended for use in relation to control of e.g. a windscreen wiper of a car. FR 1.537.956 provides two sets of valleys each of which set comprises two contact surfaces adjacently positioned and insulated from each other. A valley is formed in each surface, and the valleys are adapted to receive and hold a conducting member (a metallic ball), so that contact is formed, e.g. between two protruding terminals, when the ball connects two conducting surfaces, no contact is formed if one of the surfaces are insulating, thus providing for an on-off switch. The ball is held by a spring inside a pin, so by pushing the pin, the ball may slide from the first set of valleys to the second set of valleys, or vice versa—see FIGS. 1 and 2.

Also an extended on-off switch comprising an inclined surface and a third terminal is disclosed. The inclined surface may be used to provide a brief connection between the two conducting surfaces, so as to for example turn on a windscreen wiper once—see FIG. 3.

FR 1.537.956 may provide three stable positions, wherein the two outer positions may connect two different circuits, having an open circuit in the middle position (see p. 2, col. 2, lines 43–48).

However, FR 1.537.956 does not disclose that the inclined surfaces may be connected to external terminals that can provide a change of a program of an instrument, or provide an adjustment of e.g. a volume.

As mentioned above the use of the switch of FR 1.537.956 is exemplified in relation to controlling a windscreen wiper on a car. There is in FR 1.537.956 no mentioning of the switch being miniature switch applicable of miniature electronic devices. On the contrary, the switch of FR 1.537.956 is a rather bulky and space requiring construction capable of handling high current and voltage levels. Thus, miniaturisation is not an issued and is thus not addressed in FR 1.537.956.

SUMMARY OF THE INVENTION

It is an object of the present invention to provide an improved switch for controlling a plurality of functions/operations of a miniature electronic instrument, such as a hearing instrument.

It is a further object of the present invention to provide a switch which is user-friendlier and has a safer user-operation so as to ensure that the right switching is carried out without viewing the switching.

In a first aspect, the present invention relates to a hearing aid multifunctional switch comprising a base part, an externally activable switch arm, a first and a second set of contact surfaces disposed at a surface of said base part, the first set of contact surfaces being adjacently positioned so as to form a substantially continuous surface, the second set of electrically isolated contact surfaces being adjacently positioned so as to form a substantially continuous surface, the second set of contact surfaces being oppositely arranged to said first set so that the two sets have pairs of corresponding contact surfaces, a contact member movable between said pairs of contact surfaces for providing electrical contact between a pair of corresponding contact surfaces, and a pressure pad, wherein at least part of said pressure pad is positioned between a resilient member and the contact member, the pressure pad being biased by the resilient member against the contact member.

Preferably, the pressure pad has a substantially plane surface facing and abutting the contact member in order for the contact member to be easily movable when moved between corresponding sets of contact surfaces. Preferably, the shape of the contact member is spherical in form of a gold-coated stainless steel sphere. The pressure pad and the resilient member may be of stainless steel, but other materials may also be suitable. The resilient member applies a pressure of between 0.5 and 1 N to the contact member in order to ensure continues contact between the first and second sets of contact surfaces and the contact member when the contact member is moved along the contact surfaces.

The hearing aid multifunctional switch may further comprise a first externally assessable terminal protruding said base part and being a part of or being connected to the first set of contact surfaces, and a second externally assessable terminal protruding said base part and being a part of or being connected to one of the contact surfaces of the second set of electrically isolated contact surfaces.

The switch may be integrated in an electronic instrument for controlling the operation/function thereof. Preferably, the switch is integrated in a hearing instrument (e.g. BTE, ITE or ITC), but it may be integrated in any electronic instrument, such as mobile phones, PDAs, game devices, or audio equipment for controlling e.g. the volume, turning on/off, changing between predetermined programs, etc.

The switch may be connected to a print board in the electronic instrument via the externally assessable terminals. An "on-", "off-" or "momentary" position may be chosen by the user of the electronic instrument so as to control the operation of the instrument. The momentary position may be a position, wherein predetermined operation programs are chosen, or the volume is adjusted, each time the contact member provides contact.

The base part is adapted to receive and hold the two sets of contact surfaces and preferably, the base part is made of plastic.

The first set of contact surfaces may be formed as one single conductor connected to or being a part of one external terminal, and the second set of contact surfaces may be electrically isolated from each other by means of non-conducting middle pieces, which may be independent pieces being positioned between the contact surfaces, or they may be a part of the base part. Thus, two oppositely arranged sets of contact surfaces is provided and along which the contact member may be pushed, so as to provide contact between pairs of corresponding contact surfaces. Each time a pair of corresponding contact surfaces is connected, the operation of the instrument may change, e.g. adjustment of the volume or switching the instrument "on" or "off".

The first set of contact surfaces may be connected to a power supply terminal or ground terminal. In order to provide further controlling possibilities in the switch, the first set of contact surfaces may comprise a plurality of electrically isolated contact surfaces, each contact surface being a part of or being connected to an external terminal protruding said base part. Thus, the switch comprises more external terminals on which controlling signals can be provided for controlling the instrument.

The pairs of corresponding contact surfaces may form predetermined positions for the contact member, and between which the contact member may be moved. One or more of the pairs of corresponding contact surfaces may define valleys adapted to receive and hold the contact member in stable positions, and one or more of the pairs of corresponding contact surfaces may comprise inclined surfaces adjacent to one or more of said valleys and along which the contact may slide thereby constituting a momentary position. Thus, the switch can be moved stepwise between said valleys and slid along the inclined surfaces. As the contact member preferably is spring-loaded against said sets of contact surfaces, the contact member will be maintained in its position in the valleys. The inclined surfaces may be inclined in a direction that ensures a returning of the contact member to an adjacent valley upon being released (by an operator).

The spring-loading of the contact-member is provided by the resilient member and the pressure pad in combination. The resilient member and the pressure pad are preferably positioned within a hollow space within the switch arm so that the resilient member and the pressure pad are integrated within said switch arm. The contact member itself is preferably at least partly positioned in the hollow space in the switch arm.

The contact surfaces defining valleys are preferably connected to external terminals that provides a turn off or turn on of the instrument, when positioning the contact member in the valley, and the contact surfaces comprising inclined surfaces are preferably connected to external terminals that provide a change of a program (e.g. if the terminals are connected to a microprocessor) of the instrument. However, the valleys and inclined surfaces may define any operation-position for the instrument.

Instead of spring-loading the contact member towards the two sets of contact surfaces, the sets of contact surfaces may be spring-loaded towards said contact member. As the contact member is spring-loaded towards the contact member, and as the contact surfaces comprise valleys and inclined surfaces, a certain force is needed to move the contact member between the predetermined positions. However, this is an advantage as the user then feels in his/her finger, when the contact member is moved and in which position the contact member is being positioned. Thus, the user does not have to check, by looking at the switch, whether the switch is correctly positioned or not, which is important especially for hearing instruments that may be positioned behind the ear or in the ear.

The contact surfaces may be oriented differently in relation to the base part depending on e.g. the instrument in which the switch is to be integrated. The base part may comprise an upper and lower surface when seeing the switch in a vertical cross-sectional view, and the contact surfaces may be oriented such that a plane defined by normals to the contact surfaces of the first and second sets is substantially perpendicular to a plane defined by the upper surface of the base part (see FIGS. 1, 2 and 4), or such that a plane defined by normals to the contact surfaces of first and second sets is substantially parallel to the upper surface of the base part (see FIG. 3*c*).

The switch may further comprise a cover attached to said base part, the cover and base part together defining a housing for the contact surfaces and contact member.

A user operable member may be connected to the externally activable switch arm so as to move the contact member between predetermined positions. The contact member may comprise a substantially spherical conducting member adapted to be positioned in said predetermined positions, the spherical member may be pushed towards the corresponding contact surfaces by means of e.g. a spring positioned inside the activable switch arm. The user operable member may comprise a pin protruding said cover, or it may comprise a sliding member attached to the contact member.

One or more of the external terminals may comprise flexible terminals that may be riveted to the contact surfaces.

The two sets of contact surfaces may comprise two or three or four or five or six or more pairs of corresponding contact surfaces defining valleys and/or inclined surfaces, each contact surface of each set being a part of or connected to an external terminal. Furthermore, one or more flexible print circuit boards may be provided adjacent to the pairs of corresponding contact surfaces, so as to further increase to the number of different controlling possibilities in the switch. A flexible print board may be positioned in each end or in one end of the two sets of contact surfaces, so that the contact member provides electrical contact between a contact surface of the two sets of contact surfaces and a print circuit of the flexible print.

The switch may comprise further sets of contact surfaces, such as a third and fourth set of oppositely arranged contact surfaces having pairs of corresponding contact surfaces to be electrically connected. Thus, the switch may comprise a further contact member for providing contact between said pairs of corresponding contact surfaces of the third and fourth set of contact surfaces. Of course, the switch then also may comprise further terminals that are connected to or are a part of a contact surface, and a further user operable member connected to the further contact member.

Preferably, the resilient member is constituted by a helical formed spring having a central opening. Preferably, the pressure pad has a part extending into the central opening of the helical spring, the part extending into the central opening of the helical spring being rigidly connected to that part of the pressure pad being positioned between the resilient member and the contact member. Preferably, the pressure pad is a monolithic component.

In a preferred embodiment, the number of stationary positions formed as curved and/or substantially plane surfaces is two, whereas the number of momentary positions formed as inclined surfaces is one. In this preferred embodiment a first and outer stationary position constitutes an off position, a second and central stationary position constitutes an on position, and a third and outer position constitutes a momentary position. In the first and outer stationary position, the contact member is adapted to establish an electrical connection between the corresponding set of outer surfaces. In the second and central stationary position, the contact member is adapted to establish an electrical connection between the corresponding set of central surfaces. In the third and outer momentary position, the contact member is adapted to maintain electrical connection between at least one of the central surfaces and at least one inclined surface.

Preferably, the base part of the hearing aid multifunctional switch has a diameter less than 4 mm, such as less than 3 mm, such as approximately 2.5 mm. Similarly, the part of the pressure pad positioned between the resilient member and the contact member has a diameter less than 1 mm, such as less than 0.8 mm, such as approximately 0.6 mm. The helical spring has a length in the direction of the central opening less than 2 mm, such as approximately 1.5 mm.

BRIEF DESCRIPTION OF THE INVENTION

Figure 2:
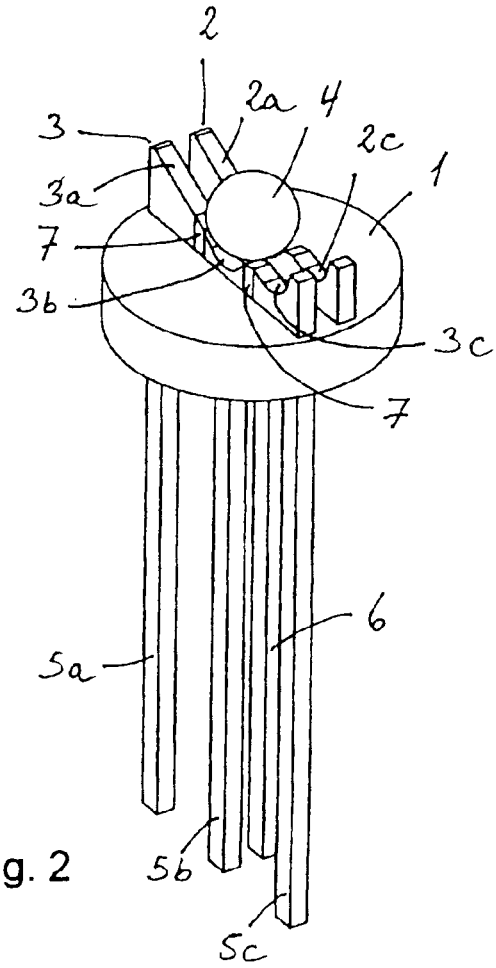
Figure 3A:
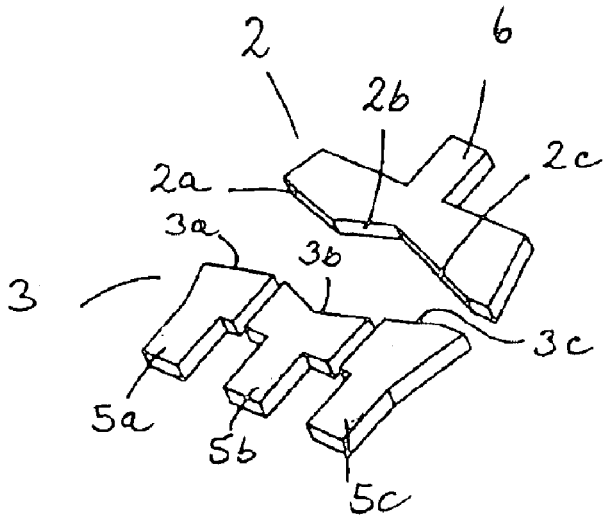
Figure 3B:
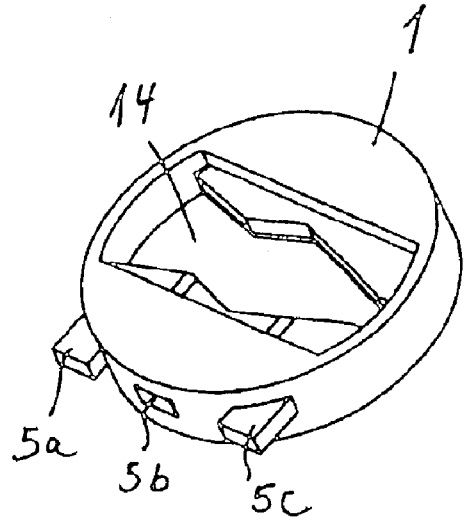
Figure 3C:
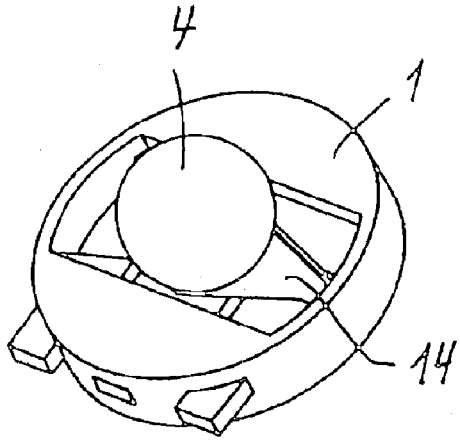
Figure 4C:
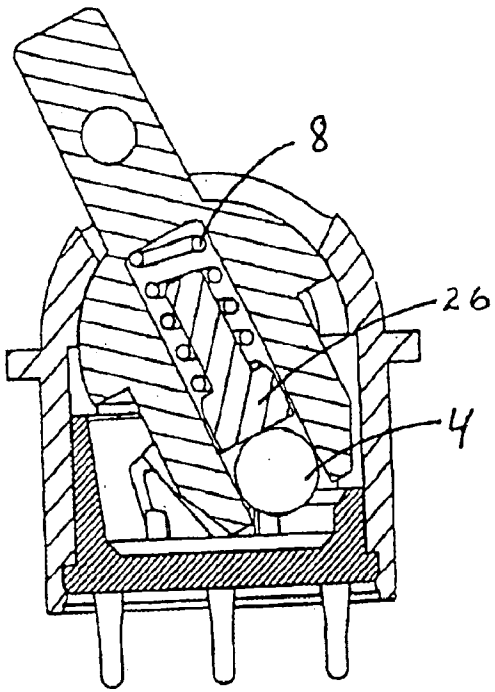
Figure 4B:
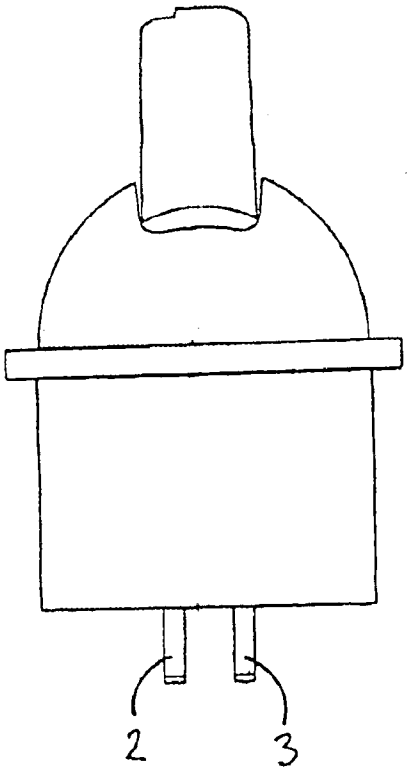
Figure 4A:
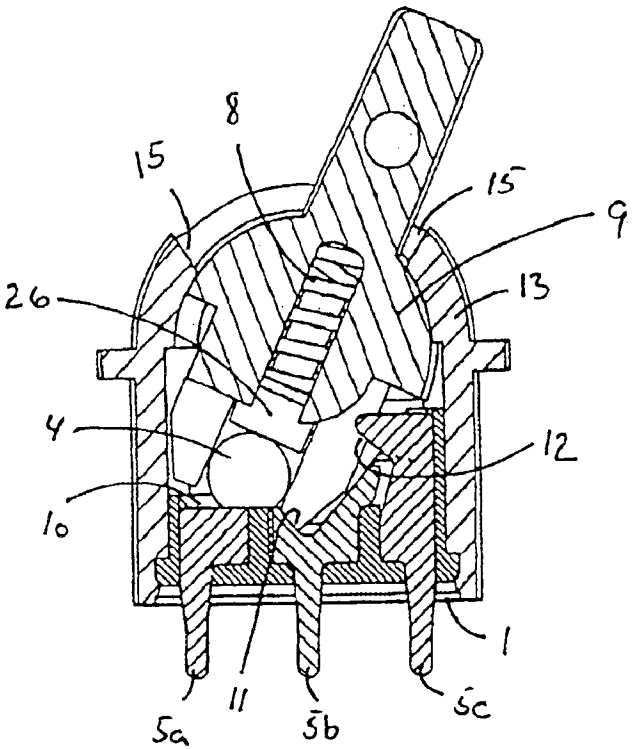
Figure 5A:
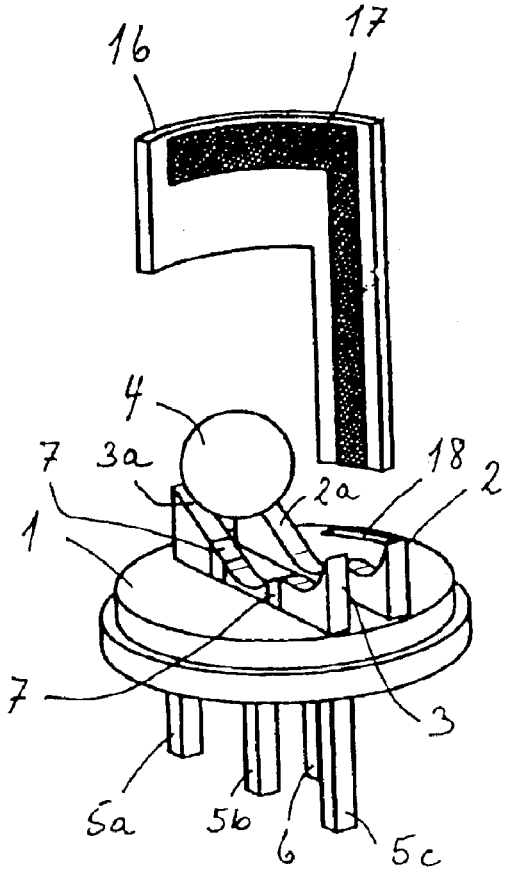
Figure 5B:
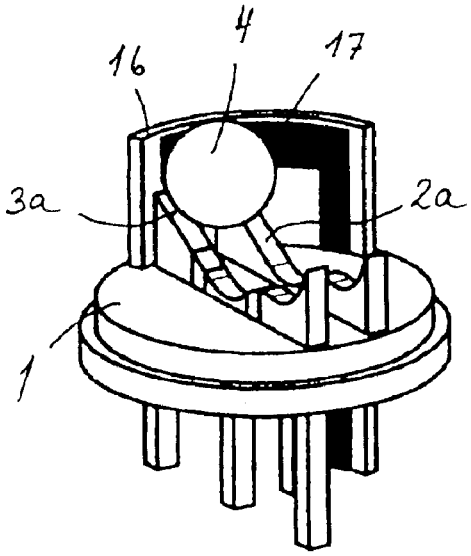
Figure 6A:
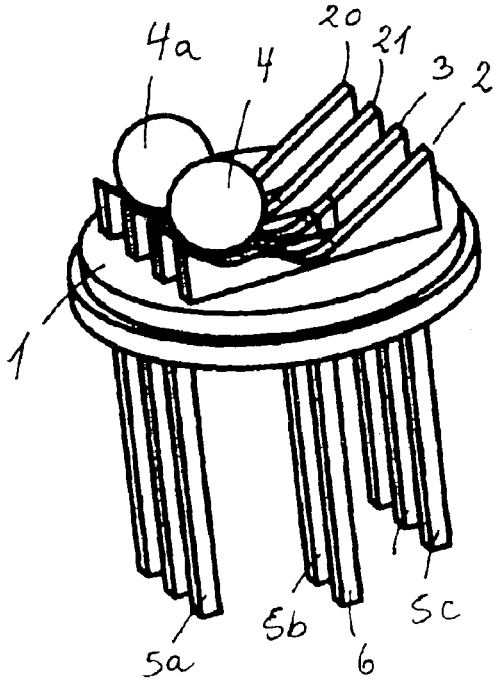
Figure 6B:
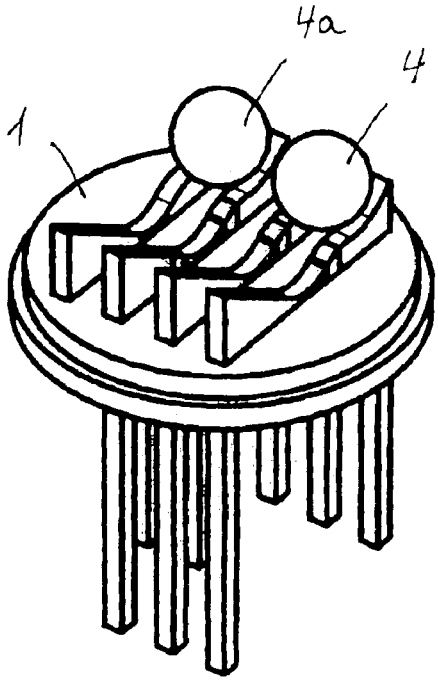

Preferred embodiments of the switch according to the invention will now be described in details with reference to the accompanying figures, wherein FIG. 1 shows a first embodiment of the sets of contact surfaces of a multifunctional switch according to the invention, FIG. 2 shows a second embodiment of the sets of contact surfaces of a multifunctional switch according to the invention, FIGS. 3*a–c* show a third embodiment of the sets of contact surfaces of a multifunctional switch according to the invention, FIGS. 4*a–c* show three cross-sectional views of an assembled multifunctional switch according to a preferred embodiment of present the invention, FIGS. 5*a–b* show a multifunctional switch according to the invention, further comprising a flexible print board positioned adjacent to the contact surfaces, and FIGS. 6*a–b* show a multifunctional switch according to the invention, further comprising further sets of contact surfaces.

While the invention is susceptible to various modifications and alternative forms, specific embodiments have been shown by way of example in the drawings and will be described in detail herein. It should be understood, however, that the invention is not intended to be limited to the particular forms disclosed. Thus, the invention is to cover all modifications, equivalents, and alternatives falling within the spirit and scope of the invention as defined by the appended claims.

DETAILED DESCRIPTION OF THE INVENTION

FIG. 1 shows a base part 1 and a first (2) and second (3) set of contact surfaces. The first set of contact surfaces (2) comprises three valleys (2*a*, 2*b*, 2*c*), and the second set of contact surfaces (3) comprises three valleys (3*a*, 3*b*, 3*c*), the two sets being oppositely arranged, so that they have pairs of corresponding contact surfaces (2*a*, 3*a*), (2*b*, 3*b*) and (2*c*, 3*c*) to be electrically connected by the contact member 4. The contact member 4 comprises a spherical conducting ball. Each contact surface of the second set is connected to or forms part of an external terminal (5*a*, 5*b*, 5*c*), and the first set of contact surfaces is connected to or forms part of one single external terminal 6. The external terminals may be of BeCu but other conducting materials may also be suitable.

Each contact surface (2*a*, 2*b*, 2*c*) may be part of or connected to an external terminal.

The contact surfaces of the second set are electrically isolated from each other by means of middle pieces 7.

FIG. 2 shows a second embodiment, which is almost the same embodiment as FIG. 1, however, one pair of corresponding contact surfaces defines inclined surfaces (2*a*, 3*a*) along which the contact member 4 slides. The contact member 4 may be pushed upwards along the contact surfaces (2*a*, 3*a*) for e.g. changing the program or for adjusting the volume of the instrument in which it is integrated. Due to the spring-loading of FIG. 4, the contact member 4 will return to the valley defined by the contact surfaces (2*b*, 3*b*) upon being released.

Instead of having two sets of valleys (2*b*, 3*b* and 2*c*, 3*c*) and one set of inclined surfaces (2*a*, 3*a*), the sets of contact surfaces may comprise two sets of inclined surfaces and one set of valleys positioned between the sets of valleys, or they may comprise only two sets of inclined surfaces.

FIGS. 3*a–c* show a third embodiment of the switch comprising a base part 1 wherein a first (2) and second (3) set of contact surfaces comprising contact surfaces (2*a*, 2*b*, 2*c*) and (3*a*, 3*b*, 3*c*) is provided. The contact surfaces being arranged vertically and not horizontally arranged, as shown in the embodiment of FIGS. 1–2. Thus, the terminals (5*a*, 5*b*, 5*c*, 6) will not be loaded by a vertical pressure generated when switching the contact member. The pairs of corresponding contact surfaces comprise two sets of valleys (2*a*, 3*a* and 2*c*, 3*c*) and one set of corresponding inclined surfaces (2*b*, 3*b*).

The contact member gains access to the contact surfaces via the groove 14 provided in the base part.

FIGS. 4*a–c* show an assembled switch comprising a base part 1, a first/second set of contact surfaces (2,3). The contact member 4 is spring-loaded towards the contact surfaces by means of spring 8 and pressure pad 26 both provided inside a user operable pin 9. The pin may be positioned in three different positions, such as an "off-position" 10, "on-position" 11 and a "momentary-position" 12. Each time the contact member is switched into the momentary-position by establishing an electrical connection between terminals 5*b* and 5*c* via surfaces 11 and 12, a change in program may be provided, or the volume may be adjusted. In the depicted embodiment, the central surface 11 includes both a valley and an inclined surface guiding the contact member to contact surface 12. Similarly, contact surface 11, which constitutes a stationary position, is formed as a substantially plane and horizontal surface without a valley.

A cover 13 is attached to the base part 1 so as to provide a closure for the contact member and the contact surfaces. The user operable pin 9 is connected to the cover via a ball-joint assembling 15, so that the pin may be switched between the different positions.

FIGS. 5*a–b* show a switch comprising a base part 1 and a first (2) and second (3) set of contact surfaces. A flexible print 16 comprising a print circuit 17 is mounted in the base part through the hole 18. The flexible print is positioned such that the contact member 4 may provide electrical contact between the contact surface 2*a* or 3*a* and the print circuit 17 by pushing the contact member upwards along the corresponding contact surfaces (2*a*, 3*a*) until it reaches the print circuit 17. Thus, further controlling possibilities of the electrical instrument is provided in the switch.

When moving the contact member towards the flexible print 16, the contact member will necessarily provide a contact between the contact surfaces 2*a*, 3*a*. In order to avoid any changes in the operation or function of the electrical instrument due to the contact provided between the surfaces 2*a*, 3*a*, a delay time may be incorporated in the switch, such that the contact between these contact surfaces does not result in any changes of the operation of the electrical instruments until the contact member has provided continuous contact therebetween for at least said delay time. Thus, it is possible to move the contact member along the contact surfaces 2*a*, 3*a* in order to reach the print circuit 17 without changing any operation or function of the electrical instrument due to the contact provided between the surfaces 2*a*, 3*a*.

FIGS. 6*a–b* show a switch comprising a base part 1 on which four sets of contact surfaces are provided, a first and second set (2,3) and a third and fourth set (20, 21). The two sets of contact surfaces (20,21) have pair of corresponding contact surfaces to be connected by the contact member 4*a*. Thus, this switch comprises a double of contact surfaces and thus more external terminals, so that the switch may control even more operations/functions of an electronic instrument. The sets of contact surface (20,21) may e.g. be used for switching on/off the instrument, while the other sets of contact surfaces (2,3) may be used for changing mode or program.

What is claimed is:

1. A hearing aid multifunctional switch, comprising a base part, an externally activable switch arm, a first and a second set of contact surfaces disposed at a surface of said base part, the first set of contact surfaces being adjacently positioned so as to form a substantially continuous surface, the second set of electrically isolated contact surfaces being adjacently positioned so as to form a substantially continuous surface, the second set of contact surfaces being oppositely arranged to said first set so that the two sets have pairs of corresponding contact surfaces, a contact member movable between said pairs of contact surfaces for providing electrical contact between a pair of corresponding contact surfaces, and a pressure pad, wherein at least part of said pressure pad is positioned between a resilient member and the contact member, the pressure pad being biased by the resilient member against the contact member, wherein the resilient member and the pressure pads are positioned within a hollow space within the switch arm so that the resilient member and the pressure pad are integrated within said switch arm.

2. A hearing aid multifunctional switch according to claim 1, wherein the pressure pad has a substantially plane surface facing and abutting the contact member.

3. A hearing aid multifunctional switch according to claim 1, further comprising a first externally assessable terminal protruding said base part and being a part of or being connected to the first set of contact surfaces, and a second externally assessable terminal protruding said base part and being a part of or being connected to one of the contact surfaces of the second set of electronically isolated contact surfaces.

4. A hearing aid multifunctional switch according to claims 1, wherein the contact member has a substantially spherical shape.

5. A hearing aid multifunctional switch according to claim 1, wherein the contact member is at least partly positioned in the hollow space in the switch arm.

6. A hearing aid multifunctional switch according to claim 5, wherein the resilient member is constituted by a helical formed spring having a central opening.

7. A hearing aid multifunctional switch according to claim 6, wherein the pressure pad has a part extending into the central opening of the helical spring, the part extending into the central opening of the helical spring being rigidly connected to that part of the pressure pad being positioned between the resilient member and the contact member.

8. A hearing aid multifunctional switch according to claim 7, wherein the pressure pad is a monolithic component.

9. A hearing aid multifunctional switch according to claim 1, wherein the pairs of contact surfaces provided by the first and second sets of contact surfaces provide stationary and/or momentary positions for the contact member.

10. A hearing aid multifunctional switch according to claim 9, wherein the stationary positions are provided as valleys formed by curved surfaces and/or substantially plane surfaces of the first and second sets of contact surfaces.

11. A hearing aid multifunctional switch according to claim 9, wherein the momentary positions are provided as inclined surfaces of the first and second sets of contact surfaces.

12. A hearing aid multifunctional switch according to claim 9, wherein the number of stationary positions formed as curved and/or substantially plane surfaces is two, and wherein the number of momentary positions formed as inclined surface is one.

13. A hearing aid multifunctional switch according to claim 12, wherein a first and outer stationary position constitutes an off position, and wherein a second and central stationary position constitutes an on position, and wherein a third and outer position constitutes a momentary position.

14. A hearing aid multifunctional switch according to claim 13, wherein, in the first and outer stationary position, the contact member is adapted to establish an electrical connection between the corresponding set of outer surfaces, and wherein, in the second and central stationary position, the contact member is adapted to establish an electrical connection between the corresponding set of central surfaces, and wherein, in the third an outer momentary position, the contact member is adapted to maintain electrical connection between at lest one of the central surfaces and at least one inclined surface.

15. A hearing aid multifunctional switch according to claim 1, wherein the base part has a diameter of approximately 2.5 mm.

16. A hearing aid multifunctional switch according to claim 1, wherein the part of the pressure pad being positioned between the resilient member and the contact member has a diameter of approximately 0.6 mm.

17. A hearing aid multifunctional switch according to claim 6, wherein the helical spring has a length in the direction of the central opening of approximately 1.45 mm.

* * * * *

UNITED STATES PATENT AND TRADEMARK OFFICE

CERTIFICATE OF CORRECTION

PATENT NO. : 6,919,519 B2
APPLICATION NO. : 10/741438
DATED : June 19, 2006
INVENTOR(S) : Søren Ravnkilde and Tomas Jacobsen It is certified that error appears in the above-identified patent and that said Letters Patent is hereby corrected as shown below:

Title Page

[63] Continuation-in-part of application No. 10/267,739, filed on Oct. 10, 2002, now abandoned, which claims priority to provisional application 60/328,364, filed October 10, 2001.

Signed and Sealed this

Nineteenth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 6,919,519 B2
APPLICATION NO. : 10/741438
DATED : July 19, 2005
INVENTOR(S) : Søren Ravnkilde and Tomas Jacobsen It is certified that error appears in the above-identified patent and that said Letters Patent is hereby corrected as shown below:

Title Page

[63] Continuation-in-part of application No. 10/267,739, filed on Oct. 10, 2002, now abandoned, which claims priority to provisional application 60/328,364, filed October 10, 2001.

This certificate supersedes the Certificate of Correction issued February 19, 2008.

Signed and Sealed this

Eleventh Day of March, 2008

JON W. DUDAS
*Director of the United States Patent and Trademark Office*